United States Patent [19]

Monacelli

[11] 4,149,297

[45] Apr. 17, 1979

[54] LOADER PARTICULARLY FOR A TACKING MACHINE

[76] Inventor: Umberto Monacelli, Via Parini 6, Monza (Milan), Italy

[21] Appl. No.: 834,260

[22] Filed: Sep. 15, 1977

[30] Foreign Application Priority Data

Sep. 15, 1976 [IT] Italy ..... 22107B/76

[51] Int. Cl.[2] ..... B25C 1/04

[52] U.S. Cl. ..... 227/136; 220/347; 220/338

[58] Field of Search ..... 227/136; 220/338, 343, 220/347

[56] References Cited

U.S. PATENT DOCUMENTS

| | | | |
|---|---|---|---|
| 2,796,608 | 6/1957 | Johnson | 227/120 |
| 3,330,462 | 7/1967 | Colechia et al. | 227/136 |

*Primary Examiner*—Roy Lake
*Assistant Examiner*—Paul A. Bell
*Attorney, Agent, or Firm*—Haseltine, Lake & Waters

[57] ABSTRACT

This invention relates to a loader particularly for a tacking machine. The loader according to the invention comprises a drum having a cylindrical side wall provided with a helical slot for receiving the shanks of the tacks of a flexible tack strip wound onto the drum. The drum is mounted onto an idle pivot pin within a housing space defined between two half-box shaped bodies connected to one another. Said half-box bodies further define an outlet mouth for the tack strip which mouth is aligned with the magazine inlet of the machine, while the axis of the pivot pin is perpendicular to those of the magazine and the firing nose.

4 Claims, 7 Drawing Figures

LOADER PARTICULARLY FOR A TACKING MACHINE

The present invention relates to a loader particularly for a tacking machine.

Pneumatically operated tacking machines are known, in which a supply magazine delivers one at a time and successively a plurality of tacks into a transversely located firing nose, in the inside of which an inserting or driving hammer is made to slide.

The supplied tacks are usually reunited to form a more ot less flexible strip and are placed at disposal of the magazine, and specifically of a reciprocating pushing member thereof, by a rear loader which is able to house a remarkable number of tacks.

It is an object of the present invention to provide a loader adapted for the use with a tacking machine of the aforesaid type, utilizing flexible-strip reunited tacks, in particular jointed each other at their head portions by droplets of thermofusible material ("hot melt") as decribed in the U.S. Pat. application No. 700 108 cause filed on June 28, 1976 in the name of the same inventor of the present invention, or reunited by passing the shanks of the tacks through the holes of a flexible strip According to the present invention this object is achieved by a loader characterized in that it comprises a drum having a cylindrical side wall provided with a helical slot for receiving the shank portions of tacks reunited so as to form a flexible strip wound onto said drum and two half-box shaped bodies connected so as to define a housing space and an idle pivot pin for said drum and a radially extending outlet mouth for said tack strip, said loader being adapted to be connected to the machine body so as to align said outlet mouth with said magazine inlet and cause the axis of said pivot pin to be perpendicular to the direction of said magazine and said firing nose.

The most important advantage of the loader according to the present invention is that it makes very easy and free of undesired stresses the unwinding operation of the tacks from their supporting drum and the delivery thereof into the magazine. Moreover the particular orientation of the loader with respect to the remaining part of the tacking machine allows the tacks to emerge from the loader in an upright condition and in this manner said tacks enter the magazine and then the firing nose; during the transfer movement of the tacks these latter are not subjected to any rotating action. At last it should be noted the remarkable simplicity of the structure, associated to a great operation safety.

The features of the present invention will become more apparent from the following detailed description of an embodiment thereof illustrated in the accompanying drawings, in which.

Figure 1:
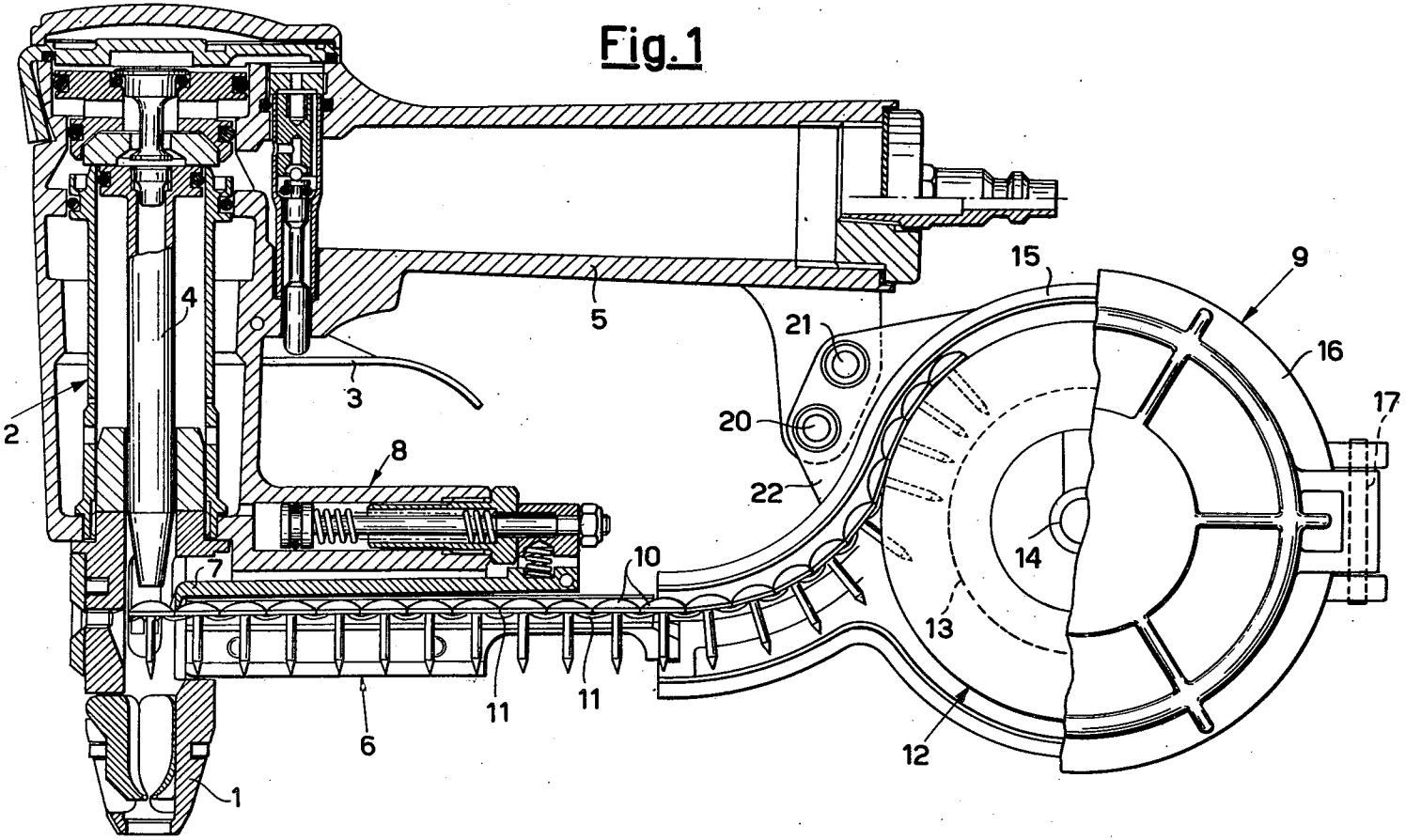
FIG. 1 is nearly completely sectioned elevation view of a tacking machine provided with a loader according to the present invention.

The tacking machine shown in FIG. 1 generally comprises a firing nose 1 in which a pneumatic cylinder-piston assembly 2, controlled by a trigger 3, causes an inserting or driving hammer 4, a cast body 5 constituting the bearing structure of the overall machine, a tack supplying magazine 6 provided with a reciprocating pushing member 7 and a tack loader 9 behind the magazine 6, to slidingly reciprocate.

In the case shown by the drawings it is supposed that the machine uses tacks 10 reunited to form one flexible strip by droplets of thermofused material or "hot melt", located between the head portions or with their shanks passed through the holes of a flexible strip. However, other systems for connecting the tacks so as to form a flexible strip may be used with a machine, and in particular with a loader, of the type shown in the drawings.

The loader 9 firstly comprises a drum 12, e.g. made of polystyrene or other reduced weight material, and in the cylindrical side wall thereof a helical slot 13 is provided, adapted to receive the shanks of the tacks.

By its axial hole 19, the drum 12 is freely rotatably mounted on a pivot pin 14 projecting from a first half box shaped body 15, with which a second half box shaped body 16, acting as a cover, cooperates, said second body being hinged to the first at 17 and being further snap connected with said first body at a radial extension defining a tack outlet mouth 18.

The thus formed loader is connected at 20 and 21 to the cast body 5 of the machine, by a bracket 22 projecting from the half box shaped body 15 in such a manner that the outlet mouth 18 is exactly aligned with the inlet of the magazine 6 and the pivot pin 14 of the drum 12 has its axis perpendicular both to the direction of the magazine 6 and that of the firing nose 1.

Thus the tacks are able to exit the loader 9 in a upright condition, said tacks remaining in said upright condition until they are separated from the rest of the strip by the hammer 4.

The intermittent advancing movement of the tacks is transmitted by the inserting between the head portions of the pushing member 7, to which a cylinder-piston assembly 8 transmits a reciprocating movement synchronized with that of the hammer 4.

Figure 2:
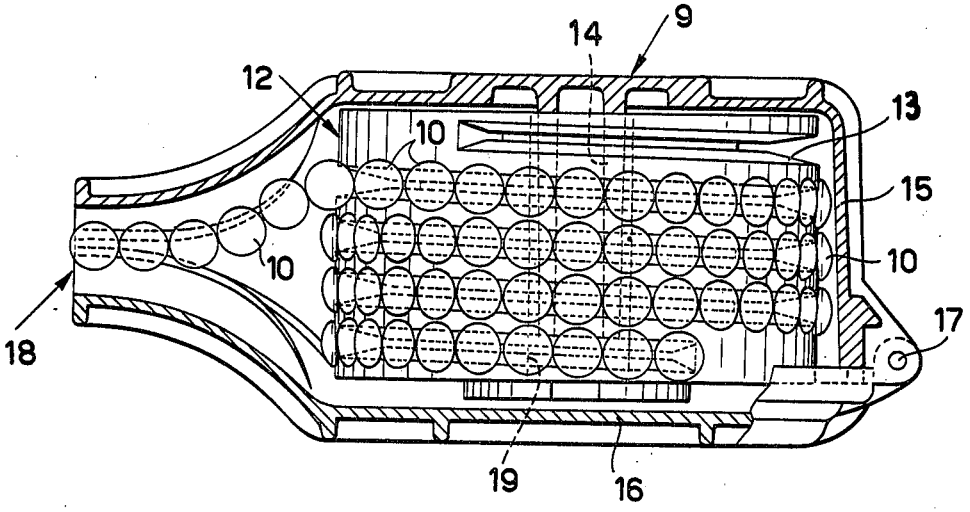
FIG. 2 shows the sole loader as partially sectioned in a substantially diametral direction.
Figure 3:
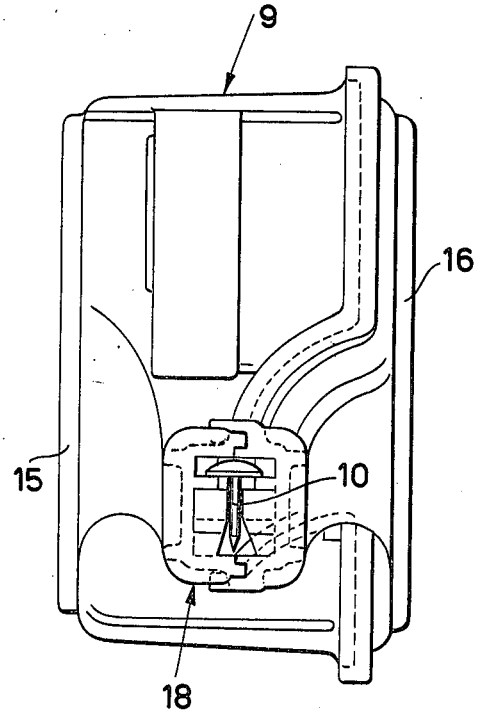
FIG. 3 shows said loader from the left with respect to FIGS. 1 and 2.

Naturally the loader may have a drum of a shape different from that of FIGS. 1, 2 and 3 with a function completely analogous to that of the drum 9. Advantageously in fact the tacks may be received into the drum with their axis inclined thus the head portions of the tacks of two adjacent rows partially overlying one another.

Figure 4:
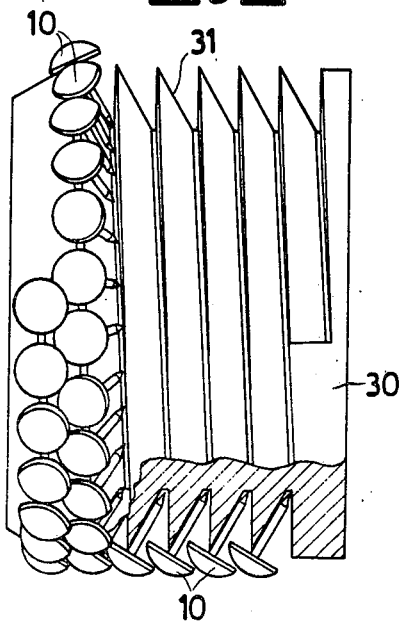

In FIG. 4 a drum 30 is shown provided with a sawtooth section helical slot 31 receiving the shanks of the tacks.

Figure 5:
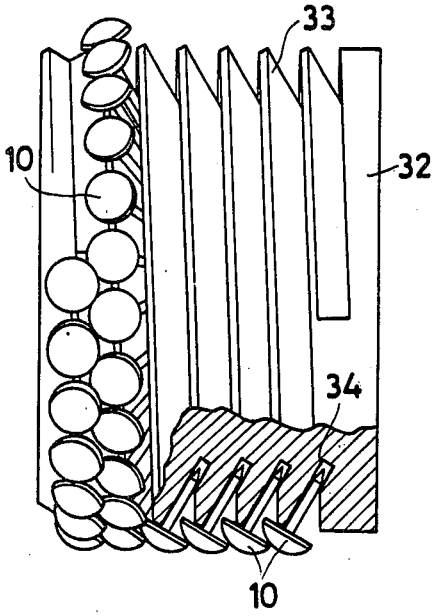
FIGS. 4, 5, 6 and 7 are partially sectioned side views of modifications of the loader of FIGS. 1-3.

In FIG. 5 a drum 32 analogous to that of FIG. 4, is shown, in which the slot 33 is provided with a bottom portion 34 adapted to lock the shank end, for a better orientation of the tacks.

Figure 6:
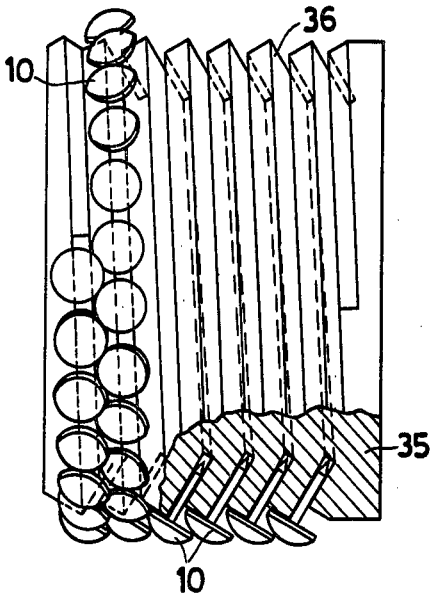

In FIG. 6 a drum 35 is shown having an oblique slot 36 adapted to tightly receive the shanks along their complete length.

Figure 7:
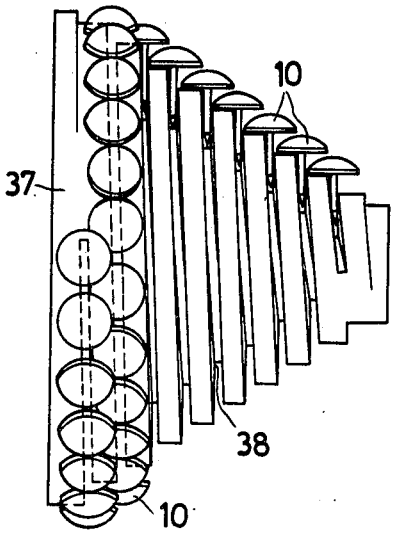

The drums 30, 32 and 35 allow to select a pitch between the turns of the tack shank receiving slot, which is less than the diameter of the tacks; thus it is possible to increase the number of the tacks received into one drum. Moreover it is possible to obtain an approaching of the slot turns by means of a conical helix pattern of the slot, as it is shown in the drum 37 of FIG. 7. In this case, although the diameter of the turns of the slot 38 progressively diminishes, the number of the received tacks may be greater than that of the arrangement shown in FIG. 2.

What we claim is:

1. A loader for tacking machine including a magazine for supplying the tacks to a firing nose transversely located with respect to said magazine, characterized in that it comprises a drum having a cylindrical side wall provided with a helical slot for receiving the shank portion of the tacks reunited so as to form a flexible strip wound onto said drum and two half-box shaped bodies connected so as to define a housing space and an idle pivot pin for said drum and a radically extending outlet mouth for said tack strip, said loader being adapted to be connected to the machine body so as to align said outlet mouth with said magazine inlet and cause the axis of said pivot pin to be perpendicular to the direction of said magazine extension and said firing nose.

2. A loader according to claim 1, characterized in that one of said half-box shaped bodies is adapted to be connected to the machine body, while the other is hinged onto the first for allowing the opening operation of said housing space for reloading the tacks.

3. A loader according to claim 1, characterized in that said helical slot receives the shank portions at a position inclined with respect to the radius of the drum, to partially overlay the head portions of the tacks located in adiacent turns of the slot.

4. A loader according to claim 1, characterized in that said drum has a generally tapering shape and in that said slot is of a substantially conic helix shape.

* * * * *